US009366255B2

(12) United States Patent
Forni

(10) Patent No.: US 9,366,255 B2
(45) Date of Patent: Jun. 14, 2016

(54) SCROLL VACUUM PUMP HAVING EXTERNAL AXIAL ADJUSTMENT MECHANISM

(71) Applicant: AGILENT TECHNOLOGIES, INC., Loveland, CO (US)

(72) Inventor: Ronald J. Forni, Lexington, MA (US)

(73) Assignee: Agilent Technologies, Inc., Santa Clara, CA (US)

( * ) Notice: Subject to any disclaimer, the term of this patent is extended or adjusted under 35 U.S.C. 154(b) by 259 days.

(21) Appl. No.: 14/094,683

(22) Filed: Dec. 2, 2013

(65) Prior Publication Data

US 2015/0152866 A1 Jun. 4, 2015

(51) Int. Cl.

| | |
|---|---|
| ***F04C 18/02*** | (2006.01) |
| ***F04C 27/00*** | (2006.01) |
| ***F04C 29/00*** | (2006.01) |

(52) U.S. Cl.

CPC ..... *F04C 18/0215* (2013.01); *F04C 29/0057* (2013.01); *F04C 27/008* (2013.01); *F04C 2230/602* (2013.01); *F04C 2240/805* (2013.01)

(58) Field of Classification Search

CPC ..... F04C 18/0215; F04C 2230/602; F04C 2240/805

See application file for complete search history.

(56) References Cited

U.S. PATENT DOCUMENTS

| | | | | |
|---|---|---|---|---|
| 1,376,291 | A | 4/1921 | Rolkerr | |
| 3,802,809 | A | 4/1974 | Vulliez | |
| 3,817,664 | A | 6/1974 | Bennett et al. | |
| 4,460,321 | A * | 7/1984 | Terauchi | F01C 1/0215 418/107 |
| 4,604,039 | A | 8/1986 | Terauchi | |
| 4,731,000 | A | 3/1988 | Haag | |
| 4,795,323 | A | 1/1989 | Lessie | |
| 4,927,340 | A | 5/1990 | McCullough | |
| 5,051,075 | A | 9/1991 | Young | |
| 5,147,192 | A | 9/1992 | Suzuki et al. | |
| 5,149,255 | A | 9/1992 | Young | |
| 5,178,526 | A | 1/1993 | Galante et al. | |
| 5,328,341 | A | 7/1994 | Forni | |
| 5,342,186 | A | 8/1994 | Swain | |
| 5,951,268 | A | 9/1999 | Pottier et al. | |
| 5,951,272 | A | 9/1999 | Fukuhara et al. | |

(Continued)

FOREIGN PATENT DOCUMENTS

| | | |
|---|---|---|
| EP | 1085211 | 3/2001 |
| JP | 61123789 | 6/1986 |

(Continued)

OTHER PUBLICATIONS

Search Report mailed Sep. 16, 2014 in UK Application No. GB1400495.6.

(Continued)

*Primary Examiner* — Mary A Davis

(57) ABSTRACT

A vacuum type of scroll pump includes a frame, a stationary plate scroll, an orbiting plate scroll, a non-energized type of tip seal or seals, an eccentric drive mechanism assembled to and supported by the frame and to which the orbiting plate scroll is assembled so as to be drivable by the eccentric drive mechanism in an orbit about a longitudinal axis of the pump, and a mechanism for adjusting the seal(s) created by the tip seal(s) without having to disassemble any of the frame, plate scrolls or parts of the eccentric drive mechanism from one another, i.e., while a pump head assembly of the pump remains intact.

18 Claims, 4 Drawing Sheets

(56) References Cited

U.S. PATENT DOCUMENTS

| | | | | |
|---|---|---|---|---|
| 6,022,202 | A | 2/2000 | Pottier et al. | |
| 6,050,793 | A | 4/2000 | Barthod et al. | |
| 6,461,129 | B2 * | 10/2002 | Liu | F04C 18/0253 418/107 |
| 7,261,528 | B2 | 8/2007 | Liepert et al. | |
| 7,442,016 | B2 | 10/2008 | Dovey et al. | |
| 7,654,805 | B2 | 2/2010 | Ishikawa | |
| 8,591,210 | B2 * | 11/2013 | Collie | F04C 18/0215 418/1 |
| 2002/0119062 | A1 | 8/2002 | Liu | |
| 2005/0220647 | A1 | 10/2005 | Liepert et al. | |
| 2007/0110605 | A1 | 5/2007 | Masuda | |
| 2008/0124236 | A1 | 5/2008 | Schofield | |
| 2009/0180909 | A1 | 7/2009 | Schofield et al. | |

FOREIGN PATENT DOCUMENTS

| | | |
|---|---|---|
| JP | 2010001858 | 1/2010 |
| WO | 2004072483 | 8/2004 |
| WO | WO2005045249 | 5/2005 |
| WO | 2006061559 | 6/2006 |

OTHER PUBLICATIONS

Office Action mailed Mar. 23, 2015 in co-pending U.S. Appl. No. 13/857,490.

Office Action mailed Jun. 19, 2015 in co-pending U.S. Appl. No. 13/798,613.

Search Report mailed Sep. 30, 2014 in UK Application No. GB1402163.8.

Office Action mailed Jun. 18, 2014 in Chinese Application No. 201420064991.5 (Unofficial/non-certified translation provided by foreign agent included).

Machine translation of JP2010001858, Jan. 7, 2010.

Office Action mailed Dec. 4, 2014 in co-pending U.S. Appl. No. 13/857,490.

Office Action mailed Jan. 2, 2015 in co-pending U.S. Appl. No. 13/798,613.

Office action dated Dec. 1, 2015 in co-pending U.S. Appl. No 13/798,613.

* cited by examiner

SCROLL VACUUM PUMP HAVING EXTERNAL AXIAL ADJUSTMENT MECHANISM

BACKGROUND OF THE INVENTION

1. Field of the Invention

The present invention relates to a scroll pump and, in particular, to a pump head assembly of a scroll pump which includes plate scrolls having nested scroll blades, and a tip seal(s) that provides a seal between the tip of the scroll blade of one of the plate scrolls and the plate of the other plate scroll. The present invention also relates to a method of calibrating a scroll pump in either the assembling of the pump or as part of a trouble shooting or maintenance operation.

2. Description of the Related Art

A scroll pump is a type of pump that includes a stationary plate scroll having a spiral stationary scroll blade, and an orbiting plate scroll having a spiral orbiting scroll blade. The stationary and orbiting scroll blades are nested with a clearance and predetermined relative angular positioning such that a pocket (or pockets) is delimited by and between the scroll blades. The scroll pump also has a frame to which the stationary plate scroll is fixed and an eccentric drive mechanism supported by the frame. These parts generally make up an assembly that may be referred to as a pump head (assembly) of the scroll pump.

The orbiting plate scroll and hence, the orbiting scroll blade, is coupled to and driven by the eccentric driving mechanism so as to orbit about a longitudinal axis of the pump passing through the axial center of the stationary scroll blade. The volume of the pocket(s) delimited by the scroll blades of the pump is varied as the orbiting scroll blade moves relative to the stationary scroll blade. The orbiting motion of the orbiting scroll blade also causes the pocket(s) to move within the pump head assembly such that the pocket(s) is selectively placed in open communication with an inlet and outlet of the scroll pump.

In an example of such a scroll pump, the motion of the orbiting scroll blade relative to the stationary scroll blade causes a pocket sealed off from the outlet of the pump and in open communication with the inlet of the pump to expand. Accordingly, fluid is drawn into the pocket through the inlet. Then the pocket is moved to a position at which it is sealed off from the inlet of the pump and is in open communication with the outlet of the pump, and at the same time the pocket is collapsed. Thus, the fluid in the pocket is compressed and thereby discharged through the outlet of the pump. The sidewall surfaces of the stationary orbiting scroll blades need not contact each other to form a satisfactory pocket(s). Rather, a minute clearance may be maintained between the sidewall surfaces at the ends of the pocket(s).

A scroll pump as described above may be of a vacuum type, in which case the inlet of the pump is connected to a chamber that is to be evacuated.

Furthermore, oil may be used to create a seal between the stationary and orbiting plate scroll blades, i.e., to form a seal(s) that delimits the pocket(s) with the scroll blades. On the other hand, certain types of scroll pumps, referred to as "dry" scroll pumps, avoid the use of oil because oil may contaminate the fluid being worked by the pump. Instead of oil, dry scroll pumps employ a tip seal or seals each seated in a groove extending in and along the length of the tip (axial end) of a respective one of the scroll blades (the groove thus also having the form of a spiral). More specifically, each tip seal is provided between the tip of the scroll blade of a respective one of the plate scrolls and the plate of the other of the plate scrolls, to create a seal which maintains the pocket(s) between the stationary and orbiting scroll blades. Further in this respect, scroll pumps of the type described above typically require a certain degree of axial compliance among respective parts of the pump head assembly to maintain an effective seal between the opposing scroll blades and plates.

In general, there are two types of tip seal arrangements to meet these requirements: energized and non-energized. An energized type of tip seal arrangement includes a tip seal seated in the tip of the scroll blade of one of the plate scrolls, and a spring that biases the tip seal against the plate of the other of the plate scrolls. A typical non-energized type of tip seal arrangement has only a solid plastic tip seal seated in the tip of the scroll blade of one of the plate scrolls and the solid plastic tip seal directly confronts the plate of the other of the plate scrolls.

In the energized type of tip seal arrangements, the tip seals are continuously worn because they are constantly biased by a positive spring force into engagement with the opposing scroll plate. As a result, spring-biased tip seals must be replaced rather frequently. The solid plastic tip seals of the non-energized arrangements have a relatively longer useful life than the conventional spring-biased tip seals. However, the use of solid tip seals presents its own set of problems.

For instance, the tolerances of dimensions of various components of scroll pumps that employ non-energized tip seals must be maintained within narrow ranges to ensure proper sealing of the tip seal without excessive compression of the seal. More specifically, in a compressor type of scroll pump, forces generated by the compressed gas act on the tip seals to force them towards the opposing plate, i.e., to in effect energize the tip seals. However, in a vacuum type of scroll pump, the tip seals operate in an environment of minimal absolute pressures. Therefore, there is little, if any gas pressure to energize the tip seals, especially at the outer wraps of the scroll blades where the greatest vacuum levels exist. Accordingly, the axial dimensions and alignment of parts constituting the head assembly must be precise to ensure that any gaps between the solid tip seals and the opposing scroll plates are minimal. If, on the other hand, the tip seals are compressed too much between the scroll blades and the opposing scroll plates, the resulting friction and heat can overload and damage parts of the pump such as the bearings of the drive mechanism.

In consideration of these potential problems in a vacuum type of scroll pump, a prior art technique uses shims to control the relative axial positions of components of the head assembly of the pump. For example, a shim having a thickness of 0.001" may be inserted into a bearing train of the drive mechanism to reduce the gap between the tip seals and the opposing scroll plates by 0.001". However, if the use of this particular shim does not result in a satisfactory performance and/or gives rise to excessive friction, the pump has to be disassembled and the shim has to be replaced with a shim of a different thickness. Then the pump has to be re-assembled and tested again. Thus, this trial and error technique may be onerous and time consuming.

SUMMARY OF THE INVENTION

The present invention is provided to overcome one or more of the problems, disadvantages and/or limitations presented by the use of solid, i.e., non-energized, type of tip seals in scroll pump.

An object of the present invention is to provide a scroll pump in which the axial disposition of the tip seal(s) of the pump can be adjusted easily.

A more specific object of the present invention is to provide a scroll pump in which the axial disposition of the tip seal(s) of the pump can be adjusted without having to disassemble at least any of the significant parts of the pump head assembly of the pump.

Still another object of the present invention is to provide a scroll pump having means by which the tip seal(s) of the pump can be axially displaced from the outside of the pump head using a tool, i.e., manually.

According to one aspect of the invention, there is provided a scroll pump having a frame, a stationary plate scroll assembled and fixed relative to the frame, an orbiting plate scroll, a respective solid plastic tip seal associated with each of at least one of the plate scrolls, an eccentric drive mechanism for driving the orbiting plate scroll, and in which the frame, the stationary plate scroll, the orbiting plate scroll and the eccentric drive mechanism constitute respective parts of a pump head of the scroll pump which are assembled to one another, and means are provided for adjusting the axial disposition of the tip seal.

The stationary plate scroll has a stationary plate, and a stationary scroll blade projecting axially from the stationary plate in a direction parallel to a longitudinal axis of the pump. The orbiting plate scroll includes an orbiting plate, and an orbiting scroll blade projecting axially from the orbiting plate in a direction parallel to the longitudinal axis. The orbiting scroll blade is nested with the stationary scroll blade. Each at least one tip seal is interposed between an axial end of the scroll blade of a respective one of the stationary and orbiting plate scrolls and the plate of the other of the stationary plate and orbiting plate scrolls. In addition, the orbiting plate scroll is assembled to and supported by the eccentric drive mechanism, and the eccentric drive mechanism is operative to drive the orbiting plate scroll in an orbit about the longitudinal axis.

The adjusting means adjusts the disposition of the tip seal(s) by allowing for the distance, in the longitudinal direction, between the stationary and orbiting plate scrolls to be adjusted while the parts of the pump head remain assembled to one another.

According to another aspect of the invention, there is provided a scroll pump having a frame, a stationary plate scroll fixed relative to the frame, an orbiting plate scroll, a respective solid plastic tip seal associated with each of at least one of the plate scrolls, an eccentric drive mechanism for driving the orbiting plate scroll, a flexure interposed between elements of the eccentric drive mechanism, and an adjusting member.

The stationary plate scroll has a stationary plate, and a scroll blade projecting axially from the stationary plate in a direction parallel to a longitudinal axis of the pump. The orbiting plate scroll includes an orbiting plate, and an orbiting scroll blade projecting axially from the orbiting plate in a direction parallel to the longitudinal axis. The orbiting scroll blade is nested with the stationary scroll blade. Each at least one tip seal is interposed between an axial end of the scroll blade of a respective one of the stationary and orbiting plate scrolls and the plate of the other of the stationary plate and orbiting plate scrolls. The eccentric drive mechanism is supported by the frame and operative to drive the orbiting plate scroll in an orbit about the longitudinal axis.

Furthermore, the eccentric drive mechanism includes a drive shaft and at least one bearing. Each at least one bearing includes an inner race, an outer race and rolling elements interposed between the inner and outer races. The drive shaft has an outer circumferential surface and a first surface extending outwardly from the outer circumferential surface.

The flexure is clamped between the inner race of the bearing and the first surface of the drive shaft. Also, the flexure has compliance, in a direction parallel to the longitudinal direction of the pump, in a region located between the inner race of the bearing and the first surface of the eccentric drive mechanism. The adjusting member is coupled to the orbiting plate scroll and the adjusting member is movable axially in opposite directions parallel to the longitudinal axis of the pump. In particular, the adjusting member is movable using a tool, i.e., manually, to adjust the axial disposition of the tip seal(s).

BRIEF DESCRIPTION OF THE DRAWINGS

These and other objects, features and advantages of the present invention will be better understood from the detailed description of the preferred embodiments thereof that follows with reference to the accompanying drawings, in which.

DETAILED DESCRIPTION OF THE PREFERRED EMBODIMENTS

Figure 1:
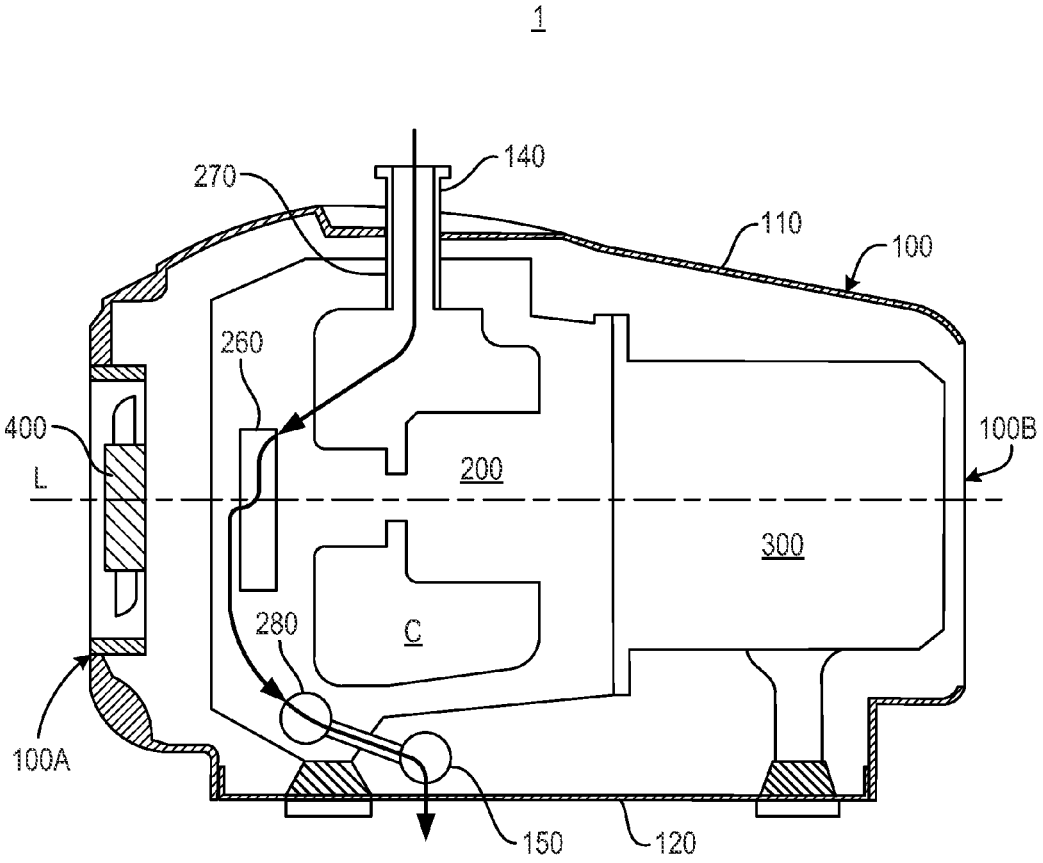
FIG. 1 is a schematic longitudinal sectional view of a scroll pump to which the present invention may be applied.

Various embodiments and examples of embodiments of the inventive concept will be described more fully hereinafter with reference to the accompanying drawings. In the drawings, the sizes and relative sizes of elements may be exaggerated for clarity. Likewise, the shapes of elements may be exaggerated and/or simplified for clarity and elements may be shown schematically for ease of understanding. Also, like numerals and reference characters are used to designate like elements throughout the drawings.

Other terminology used herein for the purpose of describing particular examples or embodiments of the inventive concept is to be taken in context. For example, the terms "comprises" or "comprising" when used in this specification indicates the presence of stated features or processes but does not preclude the presence of additional features or processes. Terms such as "fixed" may be used to describe a direct connection of two parts/elements to one another in such a way that the parts/elements can not move relative to one another or an indirect connection of the parts/elements through the intermediary of one or more additional parts. Likewise, the term "coupled" may refer to a direct or indirect coupling of two parts/elements to one another. The term "spiral" as used to described a scroll blade is used in its most general sense and may refer to any of the various forms of scroll blades known in the art as having a number of turns or "wraps". Finally, as would be readily apparent to those skilled in the art, the term "compliance" as an inherent characteristic of the flexure has a meaning similar to that of springs. That is, the term "compliance" is a vector quantity similar to the displacement vector of a spring. Thus, a phrase such as "the compliance of the flexure is in an axial direction" indicates that the axial direction is the direction along which a predetermined (designed for) relationship exists between the deflection of the flexure and the resulting force of the flexure. In the case of the present invention, that relationship or characteristic of the flexure, i.e., as represented by a force-deflection curve, may be non-linear as in the case of a Belleville spring.

Referring now to FIG. 1, a scroll vacuum pump 1 to which the present invention can be applied may include a cowling 100, and a pump head assembly 200, a pump motor 300, and a cooling fan 400 disposed in the cowling 100. Furthermore, the cowling 100 defines an air inlet 100A and an air outlet 100B at opposite ends thereof, respectively. The cowling 100 may also include a cover 110 that covers the pump head assembly 200 and pump motor 300, and a base 120 that supports the pump head assembly 200 and pump motor 300. The cover 110 may be of one or more parts and is detachably connected to the base 120 such that the cover 110 can be removed from the base 120 to access the pump head assembly 200. Furthermore, the motor 300 is detachably connected to the pump head assembly 200 so that once the cover 110 is removed from the base 120, for example, the motor 300 can be removed from the pump head assembly 200 to provide better access to the pump head assembly 200 for maintenance and/or trouble shooting.

Figure 2:
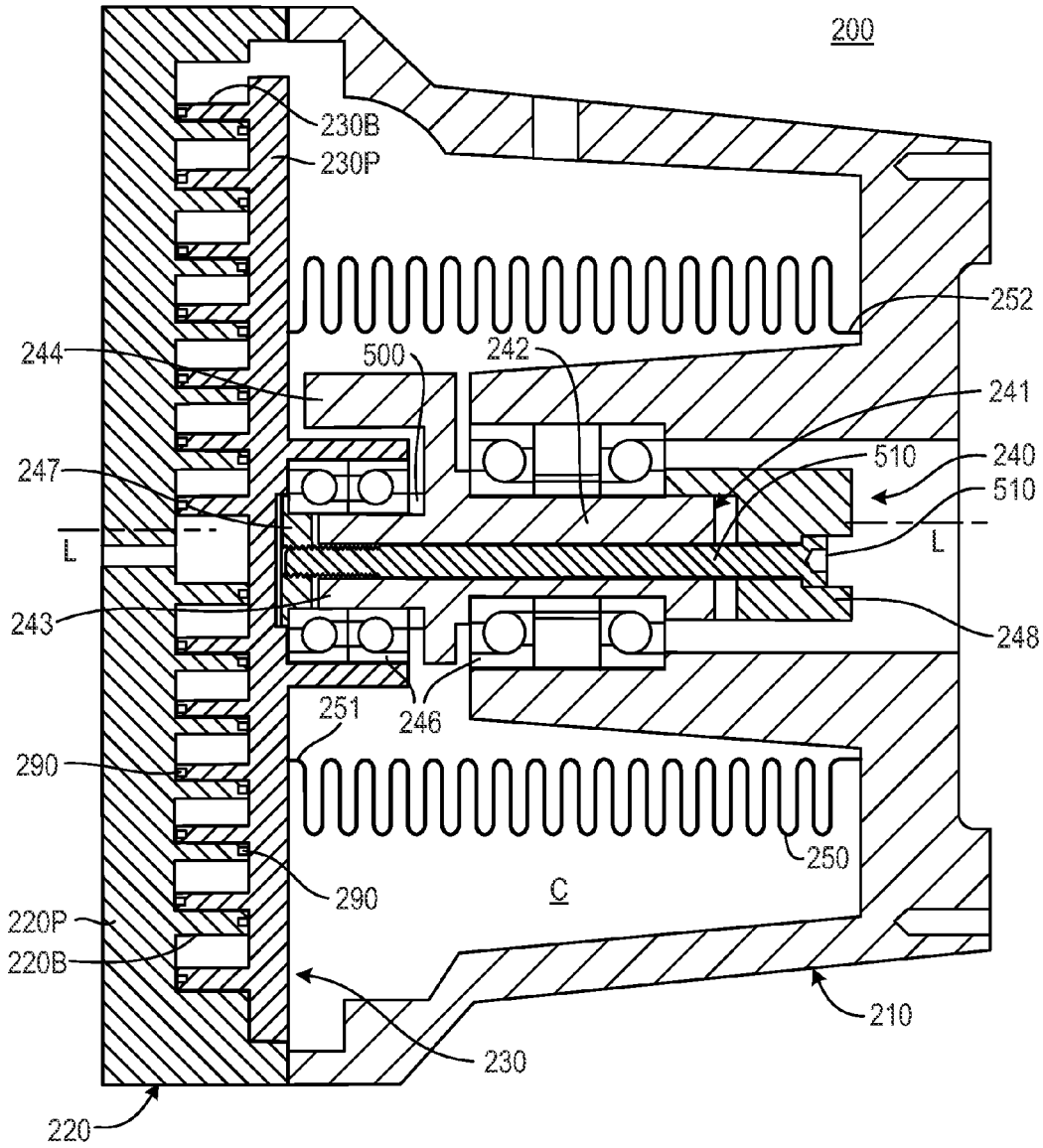
FIG. 2 is a longitudinal sectional view of a pump head of one embodiment of a scroll pump according to the present invention.

Referring now to FIG. 2, the pump head assembly 200 includes a frame 210, a stationary plate scroll 220, an orbiting plate scroll 230, and an eccentric drive mechanism 240.

The frame 210 may be one unitary piece, or the frame 210 may comprise several integral parts that are fixed to one another.

The stationary plate scroll 220 in this example is detachably mounted to the frame 210 (by fasteners, not shown). The stationary plate scroll 220 includes a stationary plate 220P, and a stationary scroll blade 220B projecting axially from a front side of the stationary plate 220P. The stationary scroll blade 220B is in the form of a spiral having a number of wraps as is known per se. The orbiting plate scroll 230 includes an orbiting plate 230P, and an orbiting scroll blade 230B projecting axially from a front side of the orbiting plate 230P. The orbiting scroll blade 230B has wraps that are complementary to those of the stationary scroll blade 220B.

The stationary scroll blade 220B and the orbiting scroll blade 230B are nested, as shown in FIG. 2, with a clearance and predetermined relative angular and axial positioning such that pockets are delimited by and between the stationary and orbiting scroll blades 220B and 230B during operation of the scroll pump 1 to be described in detail below. In this respect, the sides of the scroll blades 220B and 230B may not actually contact each other to seal the pockets. Rather, minute clearances between sidewall surfaces of the scroll blades 220B and 230B along with tip seals 290 create seals sufficient for forming satisfactory pockets.

The eccentric drive mechanism 240 includes a drive shaft 241 and a number of bearings 246. In this example, the drive shaft 241 is a crank shaft having a main portion 242 coupled to the motor 300 so as to be rotated by the motor about a longitudinal axis L of the scroll pump 1, a crank 243 whose central longitudinal axis is offset in a radial direction from the longitudinal axis L, a main counterweight 244, and a rear counter weight 248.

Also, in this example, the main portion 242 of the crank shaft is supported by the frame 210 via one or more sets of the bearings 246 so as to be rotatable relative to the frame 210. In this embodiment, the main portion 242 of the crank shaft is supported by the frame 210 via a pair of angular contact bearings 246 at least. The orbiting plate scroll 230 is mounted to the crank 243 via at least one other bearing 246. In this embodiment, the orbiting plate scroll 230 is mounted to the crank 243 via a second pair of angular contact bearings 246. Thus, the orbiting plate scroll 230 is carried by the crank 243 so as to orbit about the longitudinal axis L of the scroll pump 1 when the main shaft 242 is rotated by the motor 300, and the orbiting plate scroll 230 is supported by the crank 243 so as to be rotatable about the central longitudinal axis of the crank 243.

During a normal operation of the scroll pump 1, a load applied to the orbiting scroll blade 230B, due to the fluid being compressed in the pockets, tends to act in such a way as to cause the orbiting plate scroll 230 to rotate about the central longitudinal axis of the crank 243. However, a tubular member 250 whose ends 251 and 252 are connected to the orbiting plate scroll 230 and frame 210, respectively, and/or another mechanism such as an Oldham coupling restrains the orbiting plate scroll 230 in such a way as to allow it to orbit about the longitudinal axis L of the scroll pump 1 while inhibiting its rotation about the central longitudinal axis of the crank 243.

In the illustrated embodiment of the present invention, a tubular member 250 in the form of a metallic bellows restrains the orbiting plate scroll 230. The metallic bellows is radially flexible enough to allow the first end 251 thereof to follow along with the orbiting plate scroll 230 while the second end 252 of the bellows remains fixed to the frame 210. Furthermore, the tubular metallic bellows has some flexibility in the axial direction, i.e., in the direction of its central longitudinal axis. On the other hand, the metallic bellows may have a torsional stiffness that prevents the first end 251 of the bellows from rotating significantly about the central longitudinal axis of the bellows, i.e., from rotating significantly in its circumferential direction, while the second end 252 of the bellows remains fixed to the frame 210. Accordingly, the metallic bellows may be essentially the only means of providing the angular synchronization between the stationary and orbiting scroll blades 220B and 230B, respectively, during the operation of the scroll pump 1.

The tubular member 250 also extends around a portion of the crank shaft 243 and the bearings 246 of the eccentric drive mechanism 240. In this way, the tubular member 250 seals the bearings 246 and bearing surfaces from a space defined between the tubular member 250 and the frame 210 in the radial direction and which space may constitute the working chamber C, i.e., a vacuum chamber of the scroll pump 1, through which fluid worked by the scroll pump 1 passes. Accordingly, lubricant employed by the bearings 246 and/or particulate matter generated by the bearing surfaces can be prevented from passing into the chamber C by the tubular member 250.

Referring back to FIG. 1, the scroll vacuum pump 1 also has a pump inlet 140 and constituting a vacuum side of the scroll pump 1 where fluid is drawn into the scroll pump 1, and a pump outlet 150 and constituting a compression side where fluid is discharged to atmosphere or under pressure from the scroll pump 1. The pump head assembly 200 also has an inlet opening 270 connecting the pump inlet 140 to the vacuum chamber C, and an exhaust opening 280 leading to the pump outlet 150. Also, in FIG. 1, reference numeral 260 designates a compression mechanism of the scroll pump 1 which is constituted by the pockets defined between the stationary and orbiting plate scrolls 220 and 230.

Figure 3:
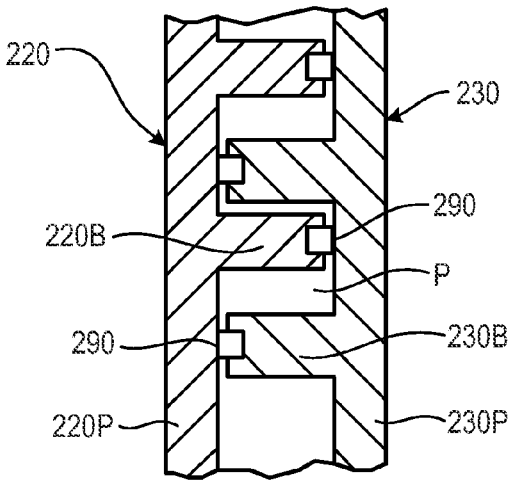
FIG. 3 is an enlarged sectional view of part of the pump head shown in FIG. 2, illustrating tip seals between the stationary plate scroll and the orbiting plate scroll.

FIGS. 2 and 3 show the tip seal(s) 290 of the pump head assembly 200 which creates an axial seal between the scroll blade of one of the stationary and orbiting plate scrolls 220, 230 and the plate (or floor) of the other of the orbiting and stationary and orbiting plate scrolls 220, 230. More specifically, the tip seal 290 is a solid plastic member seated in a groove in and running the length of the tip of the scroll blade 220B, 230B of one of the stationary and orbiting plate scrolls 220, 230 so as to be interposed between the tip of the scroll blade 220B, 230B and the plate of the other of the stationary and orbiting plate scrolls 220, 230. In this embodiment, solid plastic tip seals 290 are associated with both of the scroll blades 220B, 230B, respectively. Also, in FIG. 3, reference character P designates an arbitrary one of the above-mentioned pockets.

A scroll vacuum pump 1 having the structure described above operates as follows.

The orbiting motion of the orbiting scroll blade 230B relative to the stationary scroll blade 220B causes the volume of a lead pocket P sealed off from the pump outlet 150 and in open communication with the pump inlet 140 to expand. Accordingly, fluid is drawn into the lead pocket P through the pump inlet 140 via the inlet opening 270 of the pump head assembly 200 and the vacuum chamber C. The orbiting motion also in effect moves the pocket P to a position at which it is sealed off from the chamber C and hence, from the pump inlet 140, and is in open communication with the pump outlet 150 after one or more revolutions of the crank shaft 241. Then the pocket P is in effect moved into open communication with the outlet opening 280 of the pump head assembly 200. During this time, the volume of the pocket P is reduced. Thus, the fluid in the pocket P is compressed and thereby discharged from the scroll pump 1 through the outlet 150. Also, during this time (which corresponds to one or more orbit(s) of the orbiting plate scroll 230), a number of successive or trailing pockets P may be formed between the stationary and orbiting scroll blades 220B and 230B and are in effect similarly and successively moved and have their volumes reduced. Thus, the compression mechanism 260 in this example is constituted by a series of pockets P. In any case, as shown schematically in FIG. 1 by the arrow-headed lines, the fluid is forced through the scroll pump 1 due to the orbiting motion of the orbiting plate scroll 230 relative to the stationary plate scroll 220.

Also, by virtue of the above-described operation, the fluid flows behind the tip seals 290 and "energizes" the tip seals 290, meaning that the fluid forces the tip seals 290 against the plates 220P, 230P of the opposing plate scrolls 220, 230. The scroll pump 1 may be assembled with less axial clearance than the axial height of the tip seal 290 also forcing the tip seal 290 against the plate 220P, 230P of the opposing plate scroll 220, 230. One resulting problem is that the heat, produced by the friction between the tip seals 290 and the plates 220P, 230P of the opposing plate scrolls 220, 230, thermally distorts parts of the scroll pump 1. These thermal distortions can, in turn, significantly change the relative axial position of the orbiting plate scroll 230, and potentially in a direction that causes further increases in the friction and heat. In any case, this phenomena has the potential to reduce the life of the axial seal between the stationary and orbiting plate scrolls 220 and 230, and in addition overload the bearings 246 while also decreasing the viscosity of the grease in the bearings 246 as a result of the increased temperature. Moreover, as the scroll vacuum pump 1 is operated over the long term, the tip seals 290 become worn, eventually preventing the scroll pump 1 from generating a suitable level of vacuum.

Another problem with a solid tip seal 290 is that it does not provide sufficient axial compliance because such a tip seal 290 is relatively incompressible. However, 8,000 lbs. of force in the axial direction may be required to produce a necessary deflection of 0.001 inches in a solid plastic tip seal 290. This force, in addition to being exerted on the tip seal 290, is transmitted to the bearings 246 (FIG. 2). Accordingly, the bearings 246 may be overloaded, and the grease overheated by the increased friction and their useful life is decreased as a result.

Still another problem is that the orbiting plate scroll 230 must be set at a precise axial position in the scroll pump 1—typically within ~0.001 inches of a reference position—to prevent the bearings 246 from being overloaded or excessive leakage of the fluid being worked by the plate scrolls 220, 230.

To obviate one or more of these problems, the present invention provides means for adjusting the distance, in the longitudinal direction, between the plates 220P, 230P of the stationary and orbiting plate scrolls 220, 230 while the parts of the pump head assembly 200 remain assembled to one another, to thereby adjust the seal(s) created by the tip seal(s) 290. The adjusting means will now be described in more detail below with reference to FIGS. 2, 4 and 5.

The adjusting means of the present embodiment includes a flexure 500 and an adjusting member 510. Furthermore, a bearing or bearings 246 of the eccentric drive mechanism 240 each include an inner race, an outer race and rolling elements interposed between the inner and outer races. Also, the drive shaft 241 has a first surface 241S extending outwardly, e.g., radially outwardly, from an outer circumferential surface of the shaft.

The flexure 500 is clamped between the inner race of a bearing 246 and the first surface 241S of the drive shaft 241 that extends outwardly from an outer circumferential surface of the drive shaft 241. The flexure's compliance is designed to be substantially only in the axial direction (i.e., parallel to the longitudinal axis L) and the flexure 500 is situated such that its compliance is located in a region between the inner race of the bearing 246 and the first surface 241S of the drive shaft 241. The adjusting member 510 is accessible from the exterior of the pump head assembly 200. In some cases, the adjusting member 510 is accessible from the exterior of the scroll pump 1 itself.

The adjusting member 510 is coupled to the plate 230P of the orbiting plate scroll 230 (by the bearings 246 mounted on the crank 243 and an end cap 247 described in more detail below). The position of the adjusting member 510 and hence, that of the plate 230P of the orbiting plate scroll 230, can be adjusted axially in opposite directions parallel to the longitudinal axis L of the scroll pump 1.

More specifically, in the present embodiment, the outwardly extending or radial first surface 241S of the drive shaft 241 extends outwardly from the outer circumferential surface of the crank 243, and the flexure 250 is interposed between this surface 241S and the inner race one of the bearings 246 mounted on the crank 243. The adjusting member 510 is a threaded fastener extending freely through the crankshaft. Also, as mentioned above, the eccentric drive mechanism 240 further comprises an end cap 247 interposed between the crank 243 and the plate 230P of the orbiting plate scroll 230. The inner races of the angular contact bearings 246, disposed on the crank 243, are clamped between the end cap 247 and the flexure 500, and the end cap 247 has an internal thread mated with the thread of the fastener 510. Accordingly, rotating the fastener 510 in opposite directions displaces the end cap 247 axially in opposite directions, respectively.

Further in this respect, in the example shown best in FIG. 2, the head of the threaded fastener constituting the adjusting member 510 is exposed to or otherwise readily accessible from the outside of the pump head assembly 200. This can be achieved by exposing the head to the outside of the frame 210. The head is adapted to receive a tool by which the fastener (adjusting member 510) can be rotated. For instance, in the illustrated example, the fastener 510 is a bolt whose head has a hexagonal socket adapted to receive an Allen wrench.

The tension on the bolt (adjusting member) 510 is adjusted by changing the torque applied to tighten the bolt 510. Typically a torque wrench is used to measure the torque and based on the diameter of the bolt head and a coefficient of friction, the bolt tension can be determined from the torque. In particular, the bolt tension can be calculated using the following equation:

bolt tension (lbf)*bolt head diameter (inches)*coefficient of friction=2*tightening torque (in-lbf).

Moreover, the correlation between the torque and bolt tension is dependent on whether the bolt head is lubricated or dry as this changes the coefficient of friction by roughly a factor of 2. In any case, the bolt tension also has a correlation with the relative axial position of the orbiting plate scroll 230 relative to the fixed plate scroll 220 via the displacement of the flexure 500, and the clearance or gap (in inches) between a tip seal 290 and the opposing plate is a function of the bolt tension.

Based on the above, and according to an aspect of the invention, a given torque as applied to the bolt 510 and as measured by a torque wrench will thus provide the desired amount of clearance between the tip seal 290 and the opposing plate 220P, 230P.

Figure 5:
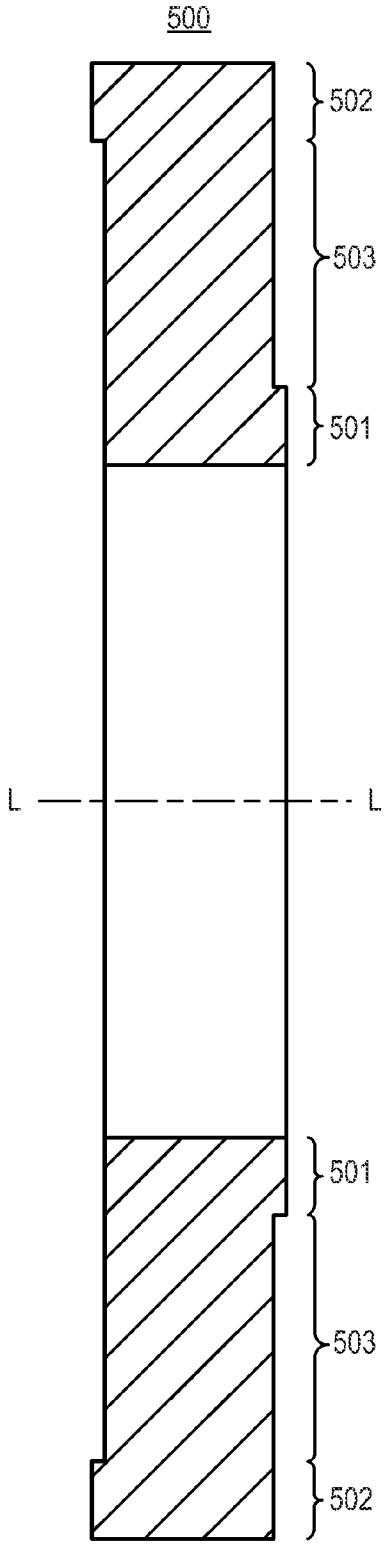
FIG. 5 is a cross-sectional view of the flexure.
Figure 4:
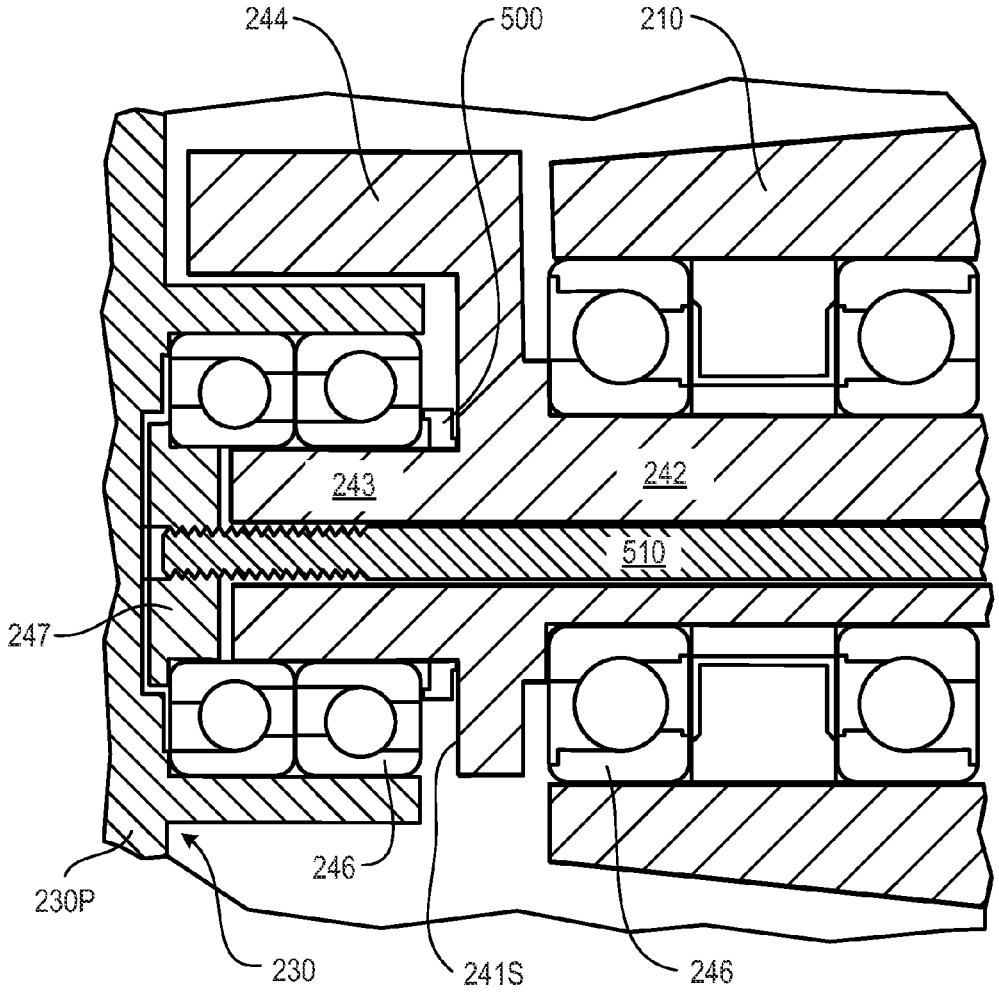
FIG. 4 is an enlarged sectional view of another part of the pump head shown in FIG. 2, illustrating a bearing train, flexure and externally accessible adjusting member of the pump head.

Referring now to FIGS. 4 and 5 especially, the flexure 500 is annular and has a radially innermost portion 501, a radially outermost portion 502 and an intermediate portion 503 connecting the radially innermost and outermost portions 501 and 502. The flexure 500 may be an annular member that is discrete from the drive shaft 241 and extends around the circumferential surface of the crank 243 as in the case of the illustrated embodiment. The end cap 247 clamps the flexure 500 between the inner races of a pair of angular contact bearings 246 and the outwardly extending surface 241S of the drive shaft 241. In this state, the intermediate portion 503 of the flexure 500 is spaced from the inner race of the bearing 246 and from the outwardly extending surface 241S of the drive shaft 241. That is, axial gaps exist between the inner race of one of the bearings 246 and one side of the flexure 500 and between the other side of the flexure 500 and the outwardly extending surface 241S of the drive shaft 241. The gaps on one side are preferably on the order of 0.004" in order to provide a hard stop so that the flexure 500 is not overloaded to the point that the stress exceeds the yield stress of the material.

Furthermore, in the illustrated embodiment, the radially outermost portion 502 of the flexure 500 contacts the inner race of one of the bearings 246, and the radially innermost portion 501 of the flexure 500 contacts the outwardly extending surface 241S of the drive shaft 241. To this end, the radially innermost and outermost portions 501 and 502 of the flexure 500 may each be in the form of a right cylinder whose central longitudinal axis is parallel to the longitudinal axis L of the scroll pump 1, and the intermediate portion 503 of the flexure 500 may be in the form of a web such as a disk that connects the radially innermost and outermost portions 501 and 502. In this case, the radially innermost portion 501 projects axially from one side of the intermediate portion (web) 503, and the radially outermost portion 502 of the flexure 500 projects axially from the other side of the intermediate portion (web) 503. Preferably, in this example of the flexure 500, the intermediate portion (web) 503 extends perpendicular to the longitudinal axis of the scroll pump 1 between the radially innermost outermost portions 501 and 502 of the flexure 500.

As the description above and the figures make clear, the inner races of some or all of the bearings 246 of the eccentric drive mechanism 240 are clamped in the axial direction by the end cap 247, the flexure 500 is disposed in the train of the inner races of these bearings 246, the end cap 247 is coupled to the orbiting plate scroll 230, and the fastener 510 is engaged with the end cap 247 such that adjusting the fastener 510 adjusts the axial position of the end cap 247 and hence, that of the orbiting plate scroll 230. Furthermore, the fastener 510 is accessible from outside the pump head assembly 200 while the assembly 200 is intact, i.e., without the need to remove any of the bearings 246, frame 210, drive shaft 241, stationary plate scroll 220, and/or orbiting plate scroll 230 from the pump head assembly 200.

Accordingly, the present invention allows for a simple method of adjusting the axial clearance between the tip seal(s) 290 and the plate 220P, 230P of the opposing plate scroll 220, 230 without having to disassemble any substantial portion of at least the pump head assembly 200. Specifically, the threaded fastener 510 in the preferred embodiment is a bolt which is used to clamp at least all of the bearings 246 located on the drive shaft 241. In particular, the bolt can provide sufficient axial force on the inner races of the duplexed set of angular contact bearings 246 to maintain the axial position of the bearings 246 on the crank 243 during operation. However, once a minimal acceptable bolt tension has been reached (~800 lbs. in an example of the preferred embodiment), increasing the bolt tension further causes the flexure 500 in the bearing train to axially deflect. Accordingly, the seal(s) created by the tip seal(s) 290 are adjusted.

This method can be implemented at various times to enhance or optimize the performance of the scroll pump 1, including during scheduled maintenance in which case no complex or time consuming disassembly steps are required. The flexure 500 in the preferred embodiment allows for axial adjustments on the order of +/−0.002" as was alluded to above.

Furthermore, it should be noted that the flexure 500 must be able to transmit and withstand the required forces, including the bolt tension, while only experiencing a nominal amount of stress. In the example described so far, the flexure 500 needs to be designed to not only transmit a clamping force on the order of ~800 pounds of force but to deflect by an additional ~0.004" when the bolt tension is increased without the stress exceeding the yield strength of the material of the flexure 500. Under typical conditions such as these, the stress can be extremely high, e.g., over 100,000 psi.

Considering these requirements, it is quite apparent that the flexure 500 must be precisely engineered. An annular member having the cross section shown best in FIG. 5, and of precipitation hardened stainless steel, as a preferred material, has been shown to meet these requirements. Another advantageous feature of a flexure 500 having the cross section shown in FIG. 5 is that it provides a hard stop. That is, once the tension on the bolt 510 is maximal, the flexure 500 may be designed so that its radially outermost portion 502 contacts a radial surface, i.e., first surface 241S in the present embodiment. Thus, any additional bolt tension produced by overtightening the bolt will not result in additional deflection of the flexure 500, which additional deflection could otherwise exceed the yield strength.

Also, the flexure 500 does not continue to "energize" the tip seals 290 after they are worn in by an amount greater than the flexure 500 was originally deflected in the axial direction during assembly, regardless of the force-deflection curve to which the flexure 500 conforms, provided that the effective spring constant is greater than a critical predetermined minimum value further explained below. Accordingly, the tip seals 290 do not have to be replaced as frequently.

Finally, an embodiment of the inventive concept and examples thereof have been described above in detail. The inventive concept may, however, be embodied in many different forms and should not be construed as being limited to the embodiments described above. Rather, these embodiments were described so that this disclosure is thorough and complete, and fully conveys the inventive concept to those skilled in the art. Thus, the true spirit and scope of the inventive concept is not limited by the embodiment and examples described above but by the following claims.

What is claimed is:

1. A scroll pump, comprising:

a frame;

a stationary plate scroll assembled and fixed relative to the frame, the stationary plate scroll comprising a stationary plate, and a stationary scroll blade projecting axially from the stationary plate in a direction parallel to a longitudinal axis of the scroll pump;

an orbiting plate scroll comprising an orbiting plate, and an orbiting scroll blade projecting axially from the orbiting plate in a direction parallel to the longitudinal axis, and nested with the stationary scroll blade;

at least one solid plastic tip seal interposed between an axial end of at least one of the stationary scroll blade and the orbiting scroll blade and the opposing one of the orbiting plate or the stationary plate;

an eccentric drive mechanism assembled to and supported by the frame, the orbiting plate scroll being assembled to and supported by the eccentric drive mechanism, and the eccentric drive mechanism being operative to drive the orbiting plate scroll in an orbit about the longitudinal axis, wherein the frame, the stationary plate scroll, the orbiting plate scroll and the eccentric drive mechanism constitute respective parts of a pump head of the scroll pump, which are assembled to one another; and a threaded fastener that adjusts the distance, in the longitudinal direction, between the stationary plate and the orbiting plate while said parts of the pump head remain assembled to one another.

2. The scroll pump as claimed in claim 1, wherein the eccentric drive mechanism includes, as respective parts of the pump head, a drive shaft and at least one bearing disposed on and assembled to the drive shaft.

3. The scroll pump as claimed in claim 2, wherein the drive shaft is a crankshaft including a main shaft and a crank, the at least one bearing comprises a pair of bearings disposed on and assembled to the crank, and the orbiting plate scroll is disposed on the pair of bearings such that the orbiting plate scroll and the pair of bearings are assembled to one another.

4. A scroll pump, comprising:

a frame;

a stationary plate scroll fixed relative to the frame, the stationary plate scroll comprising a stationary plate, and a scroll blade projecting axially from the stationary plate in a direction parallel to a longitudinal axis of the scroll pump;

an orbiting plate scroll comprising an orbiting plate, and an orbiting scroll blade projecting axially from the orbiting plate in a direction parallel to the longitudinal axis, and nested with the stationary scroll blade;

at least one solid plastic tip seal interposed between an axial end of at least one of the stationary scroll blade and the orbiting scroll blade and the opposing one of the orbiting plate or the stationary plate;

an eccentric drive mechanism supported by the frame and operative to drive the orbiting plate scroll in an orbit about the longitudinal axis, the eccentric drive mechanism comprising a drive shaft and at least one bearing, each said at least one bearing comprising an inner race, an outer race and rolling elements interposed between the inner race and the outer race, and the drive shaft comprising an outer circumferential surface and a first surface extending outwardly from the outer circumferential surface;

a flexure clamped between the inner race of the at least one bearing and the first surface of the drive shaft, and the flexure having compliance, in a direction parallel to the longitudinal direction of the scroll pump, in a region located between said inner race and said first surface; and a threaded fastener coupled to the orbiting plate scroll, and the threaded fastener being movable axially in opposite directions parallel to the longitudinal axis of the scroll pump.

5. The scroll pump as claimed in claim 4, wherein the drive shaft is a crankshaft including a main shaft and a crank, and the at least one bearing of the eccentric drive mechanism comprises a pair of bearings disposed on the crank and to which the orbiting plate scroll is mounted.

6. The scroll pump as claimed in claim 5, wherein said first surface extends outwardly from an outer circumferential surface of the crank.

7. The scroll pump as claimed in claim 6, wherein the threaded fastener extends freely through the crankshaft, the eccentric drive mechanism further comprises an end cap interposed between the crank and the orbiting plate, the pair of bearings are clamped between the end cap and the flexure, and the end cap is threaded to the threaded fastener whereby rotation of the threaded fastener in opposite rotational directions displaces the end cap axially in the opposite directions parallel to the longitudinal axis, respectively.

8. The scroll pump as claimed in claim 7, wherein the threaded fastener has a head that is exposed to the outside of the frame.

9. The scroll pump as claimed in claim 5, wherein the pair of bearings is a pair of angular contact bearings.

10. The scroll pump as claimed in claim 5, wherein said first surface extends outwardly from an outer peripheral surface of the crank, the flexure is an annular member extending around the outer peripheral surface of the crank, and the flexure is interposed between said pair of bearings and said first surface of the drive shaft.

11. The scroll pump as claimed in claim 10, wherein the annular member has a radially innermost portion contacting said first surface of the drive shaft, a radially outermost portion contacting the inner race of one of said bearings, and an intermediate portion connecting the radially innermost portion and the radially outermost portion, and the intermediate portion is spaced from the inner race of said one of the bearings and from said first surface.

12. The scroll pump as claimed in claim 11, wherein the intermediate portion of the flexure is a web, the radially innermost portion and the radially outermost portion of the annular member each have the form of a right cylinder whose central longitudinal axis is parallel to the longitudinal axis of the scroll pump, the radially innermost portion projects axially from one side of the web, and the radially outermost portion projects axially from the other side of the web.

13. The scroll pump as claimed in claim 12, wherein the web extends perpendicular to longitudinal axis of the scroll pump from the radially innermost portion to the radially outermost portion of the annular member.

14. The scroll pump as claimed in claim 4, wherein the flexure is annular and has a radially innermost portion, a radially outermost portion and an intermediate portion connecting the radially innermost portion and the radially outermost portion, and the intermediate portion is spaced from said inner race of the at least one bearing and from said first surface of the drive shaft.

15. The scroll pump as claimed in claim 14, wherein the radially outermost portion of the flexure contacts said inner race of the at least one bearing.

16. The scroll pump as claimed in claim 14, wherein the radially innermost portion of the flexure contacts one of said inner race of the at least one bearing and the first surface of the drive shaft, and the radially outermost portion of the flexure contacts the other of said inner race of the at least one bearing and the first surface of the drive shaft.

17. The scroll pump as claimed in claim 4, wherein:

the flexure is an annular member extending around the drive shaft;

the annular member has a radially innermost portion and a radially outermost portion each in the form of a right cylinder whose central longitudinal axis is parallel to the longitudinal axis of the scroll pump, and a web that connects the radially innermost portion and the radially outermost portion, and the radially innermost portion projects axially from one side of the web, and the radially outermost portion projects axially from the other side of the web.

18. The scroll pump as claimed in claim 17, wherein the web extends perpendicular to the longitudinal axis of the scroll pump from the radially innermost portion to the radially outermost portion of the annular member.

* * * * *